US008668064B2

(12) United States Patent
Santy et al.

(10) Patent No.: US 8,668,064 B2
(45) Date of Patent: Mar. 11, 2014

(54) ASSEMBLY STRUCTURE FOR A LUGGAGE CASE

(75) Inventors: Dirk Santy, Koekelare (BE); Luc K. F. Huyghe, Waregem (BE)

(73) Assignee: Samsonite IP Holdings S.a. r.l., Luxembourg (LU)

( * ) Notice: Subject to any disclaimer, the term of this patent is extended or adjusted under 35 U.S.C. 154(b) by 347 days.

(21) Appl. No.: 12/970,122

(22) Filed: Dec. 16, 2010

(65) Prior Publication Data

US 2011/0168506 A1 Jul. 14, 2011

Related U.S. Application Data

(60) Provisional application No. 61/288,110, filed on Dec. 18, 2009.

(51) Int. Cl.
*A45C 13/04* (2006.01)
*A45C 5/03* (2006.01)

(52) U.S. Cl.
USPC ..... 190/127; 190/24; 150/130; 29/428

(58) Field of Classification Search
USPC ..... 190/107, 124, 125, 127, 24, 26, 28, 190/122; 150/127, 130; 383/119; 29/428
See application file for complete search history.

(56) References Cited

U.S. PATENT DOCUMENTS 1,808,375 A 6/1931 Plooster
2,298,786 A * 10/1942 Dubofsky et al. ..... 190/126
2,373,573 A * 4/1945 Langford et al. ..... 190/115
3,158,238 A 11/1964 Kish
3,165,178 A 1/1965 Pelavin et al.
3,330,389 A 7/1967 Kaplan
3,944,032 A 3/1976 Samhammer et al.
4,004,664 A 1/1977 Pelavin et al.
4,026,750 A 5/1977 Szabo
4,055,239 A 10/1977 Weiner
4,123,839 A 11/1978 Weiner
4,176,734 A 12/1979 Wang
4,298,104 A 11/1981 Leong
4,539,705 A 9/1985 Baines
4,573,203 A 2/1986 Peppiatt
4,598,802 A 7/1986 Abenaim
4,610,334 A 9/1986 Pelavin
4,658,998 A 4/1987 Belka (Continued)

FOREIGN PATENT DOCUMENTS

DE 202010017619 3/2012
EM 000036710-0006 5/2003

(Continued)

OTHER PUBLICATIONS

International Search Report of corresponding International Application No. PCT/EP2010/070319, dated Mar. 23, 2011, 5 pages.

*Primary Examiner* — Sue A Weaver
(74) *Attorney, Agent, or Firm* — Dorsey & Whitney LLP

(57) ABSTRACT

One example may be directed to a luggage case including a first wire frame element forming at least a partial shape of a main body, an inner material attached at least in part to the first wire frame element, an outer material positioned over the first wire frame element, and a second wire frame element attached at least in part to the inner material and the outer material. The outer material is not attached to the first wire frame element.

17 Claims, 6 Drawing Sheets

(56) References Cited

U.S. PATENT DOCUMENTS

| | | | | | |
|---|---|---|---|---|---|
| 4,762,211 | A | | 8/1988 | Krenzel | |
| 4,781,278 | A | | 11/1988 | Sadow | |
| 4,782,556 | A | | 11/1988 | Kim | |
| 4,823,924 | A | | 4/1989 | Goodin | |
| D302,077 | S | | 7/1989 | Kim | |
| 4,867,575 | A | | 9/1989 | Wood | |
| 4,874,255 | A | | 10/1989 | Ball et al. | |
| 4,895,230 | A | * | 1/1990 | King | 190/107 |
| 4,907,728 | A | | 3/1990 | Giblet | |
| D315,285 | S | | 3/1991 | Workman | |
| 5,031,734 | A | | 7/1991 | King | |
| 5,036,978 | A | | 8/1991 | Frank et al. | |
| 5,096,106 | A | | 3/1992 | Foster et al. | |
| 5,113,983 | A | | 5/1992 | Workman | |
| 5,115,895 | A | | 5/1992 | Myers | |
| 5,121,995 | A | | 6/1992 | Newman et al. | |
| 5,181,590 | A | | 1/1993 | Carpenter et al. | |
| 5,197,580 | A | * | 3/1993 | Berman et al. | 190/107 |
| 5,253,792 | A | | 10/1993 | Foster et al. | |
| 5,282,687 | A | | 2/1994 | Yee | |
| 5,303,805 | A | | 4/1994 | Hauser | |
| 5,529,156 | A | | 6/1996 | Yang | |
| 5,560,459 | A | | 10/1996 | Lin | |
| 5,620,069 | A | | 4/1997 | Hurwitz | |
| 5,634,539 | A | | 6/1997 | Gordon | |
| 5,755,311 | A | | 5/1998 | Younessian et al. | |
| 5,894,007 | A | | 4/1999 | Younessian et al. | |
| D419,853 | S | | 2/2000 | Workman et al. | |
| 6,119,835 | A | | 9/2000 | Lin | |
| 6,148,973 | A | | 11/2000 | Chang | |
| D437,202 | S | | 2/2001 | O'Neil | |
| 6,260,680 | B1 | | 7/2001 | Lin | |
| 6,283,261 | B1 | | 9/2001 | Sher | |
| 6,293,378 | B1 | | 9/2001 | Lin | |
| D460,677 | S | | 7/2002 | Proot et al. | |
| D461,055 | S | | 8/2002 | Szyf | |
| RE37,924 | E | | 12/2002 | Kellogg et al. | |
| 6,618,914 | B1 | | 9/2003 | Chen | |
| D489,531 | S | | 5/2004 | Oh | |
| 6,892,434 | B2 | | 5/2005 | Fenton et al. | |
| D507,734 | S | | 7/2005 | Willems | |
| 6,953,110 | B2 | | 10/2005 | Santy et al. | |
| D526,784 | S | | 8/2006 | Proot | |
| 7,207,426 | B2 | * | 4/2007 | Godshaw et al. | 190/1 |
| D554,372 | S | | 11/2007 | Scicluna et al. | |
| 7,458,600 | B1 | | 12/2008 | Berke et al. | |
| D600,095 | S | | 9/2009 | Mattson et al. | |
| 2001/0034923 | A1 | | 11/2001 | Ho | |
| 2002/0100148 | A1 | | 8/2002 | Tominaga et al. | |
| 2004/0070242 | A1 | | 4/2004 | Illulian | |
| 2004/0182667 | A1 | | 9/2004 | Lin | |
| 2005/0056511 | A1 | | 3/2005 | Hsieh | |
| 2005/0263364 | A1 | | 12/2005 | Sher | |
| 2006/0064852 | A1 | | 3/2006 | Willems | |
| 2006/0137951 | A1 | | 6/2006 | Lai | |
| 2007/0086845 | A1 | | 4/2007 | Merzon | |
| 2009/0022430 | A1 | | 1/2009 | Hutchinson et al. | |
| 2011/0088987 | A1 | | 4/2011 | Santy et al. | |
| 2013/0220755 | A1 | | 8/2013 | Meersschaert et al. | |

FOREIGN PATENT DOCUMENTS

| | | | | |
|---|---|---|---|---|
| EM | 000036710-0007 | | | 5/2003 |
| EM | 000036710-0009 | | | 5/2003 |
| EM | 001241350-0001 | | | 10/2010 |
| FR | 1032424 | A | | 3/1953 |
| FR | 2375801 | | | 7/1978 |
| FR | 2531843 | | | 2/1984 |
| GB | 349755 | | | 6/1931 |
| GB | 851184 | A | | 10/1960 |
| GB | 2184940 | A | * | 7/1987 |
| GB | 2 433 065 | A | | 6/2007 |
| WO | 9419981 | | | 9/1994 |
| WO | 9944460 | | | 9/1999 |
| WO | 2007014804 | | | 2/2007 |
| WO | 2008098116 | A1 | | 8/2008 |
| WO | 2012056009 | A2 | | 5/2012 |

* cited by examiner

ASSEMBLY STRUCTURE FOR A LUGGAGE CASE

CROSS-REFERENCE TO RELATED APPLICATION

This application claims the benefit under 35 U.S.C. §119 (e) to U.S. provisional application No. 61/288,110, entitled "Assembly Structure For a Luggage Case" filed on Dec. 18, 2009, which is hereby incorporated herein by reference in its entirety.

FIELD OF THE INVENTION

This invention relates to the construction of luggage cases, and more particularly, to a luggage case construction in which the inner lining material is anchored to an internal wire frame structure, thereby resulting in fewer or no seams and stitching to attach the inner lining material to and through the outer material.

BACKGROUND

A luggage case typically includes an outer material layer defining an outer surface that is handled by a user, an inner material layer that lines the interior of the luggage case, a frame defining the peripheral shape of the luggage, a reinforcement structure configured to reinforce and maintain the shape of the frame, and one or more of various opening structures to allow access to the interior space inside the luggage case. These components, which can include foam, wires, poly sheets, or the like, are typically attached together in a manner that requires anchoring of the inner material layer to the outer material layer using various attachment means or structures, such as sewing, riveting, bonding, anchors, and so on. This anchoring of the inner material layer to the outer material layer can create interruptions and marring, for example, by stitching or seams, on the outer surface of the luggage case, which can compromise its overall aesthetic appearance. The anchoring of the inner and outer material layers can further compromise the structural integrity of the luggage case, since each of these layers can be torn or otherwise damaged due to pulling of the other. This typical construction of luggage cases generally requires that the luggage case be built from the outside to the inside, which also can limit the structural and aesthetic design choices for constructing the luggage case.

It is to satisfy the above-recognized issues that the present invention has been developed.

SUMMARY

One embodiment of a luggage case may include a first wire frame element forming at least a partial peripheral shape of a main body, an inner material attached at least in part to the first wire frame element, an outer material positioned over the first wire frame element, and a second wire frame element attached at least in part to the inner material and the outer material. The outer material is not attached to the first wire frame element.

In another embodiment, the outer material may be free of any interruptions created by anchoring the first wire frame element to the outer material. In a further embodiment, the partial shape may include at least a partial peripheral shape of the main body. In another embodiment, the inner material may define one or more pockets configured to receive one or more structural members. In some embodiments, the structural members are configured as one or more plates.

In another embodiment, one or more structural members may be configured to bias the first wire frame element away from the second wire frame element. Additionally, one or more structural members may be formed from a structurally resilient material. In another embodiment, the first wire frame element may be positioned in a different plane than the second wire frame element.

Another embodiment is directed to a method of making a luggage case. The method includes forming a first wire frame element into at least a portion of a shape of luggage, attaching an inner material to the first wire frame element, and laying an outer material over the first wire frame element without securing the outer material to the first wire frame element to form an outer wall of the luggage case.

In another embodiment of the method, the outer wall of the luggage case does not include any external interruptions. In a further embodiment, the inner material may be attached to the first wire frame element by forming a hem around a portion of the first wire frame element. Another embodiment may include attaching the inner material to a second wire frame element. A further embodiment may include attaching at least a portion of the outer material to the second wire frame element.

Another embodiment of the method may further include forming one or more pockets in the inner material. Another embodiment may include positioning one or more structural members in the one or more pockets of the inner material. Additionally, the one or more structural members may be configured to bias the second wire frame element away from the first wire frame element.

Another embodiment of a luggage case may include a first wire frame element forming at least a partial shape of a main body, an inner material attached at least in part to the first wire frame element, and an outer material positioned over the first wire frame element. The outer material may not be substantively attached to the first wire frame element.

In another embodiment, a second wire frame element may be attached at least in part to the inner material and the outer material. Additionally, the inner material may define one or more pockets configured to receive one or more structural members.

BRIEF DESCRIPTION OF THE DRAWINGS

The features and advantages of the present invention will be more readily apparent from the following detailed description, illustrated by way of example in the drawing figures, wherein.

DETAILED DESCRIPTION

Figure 1:
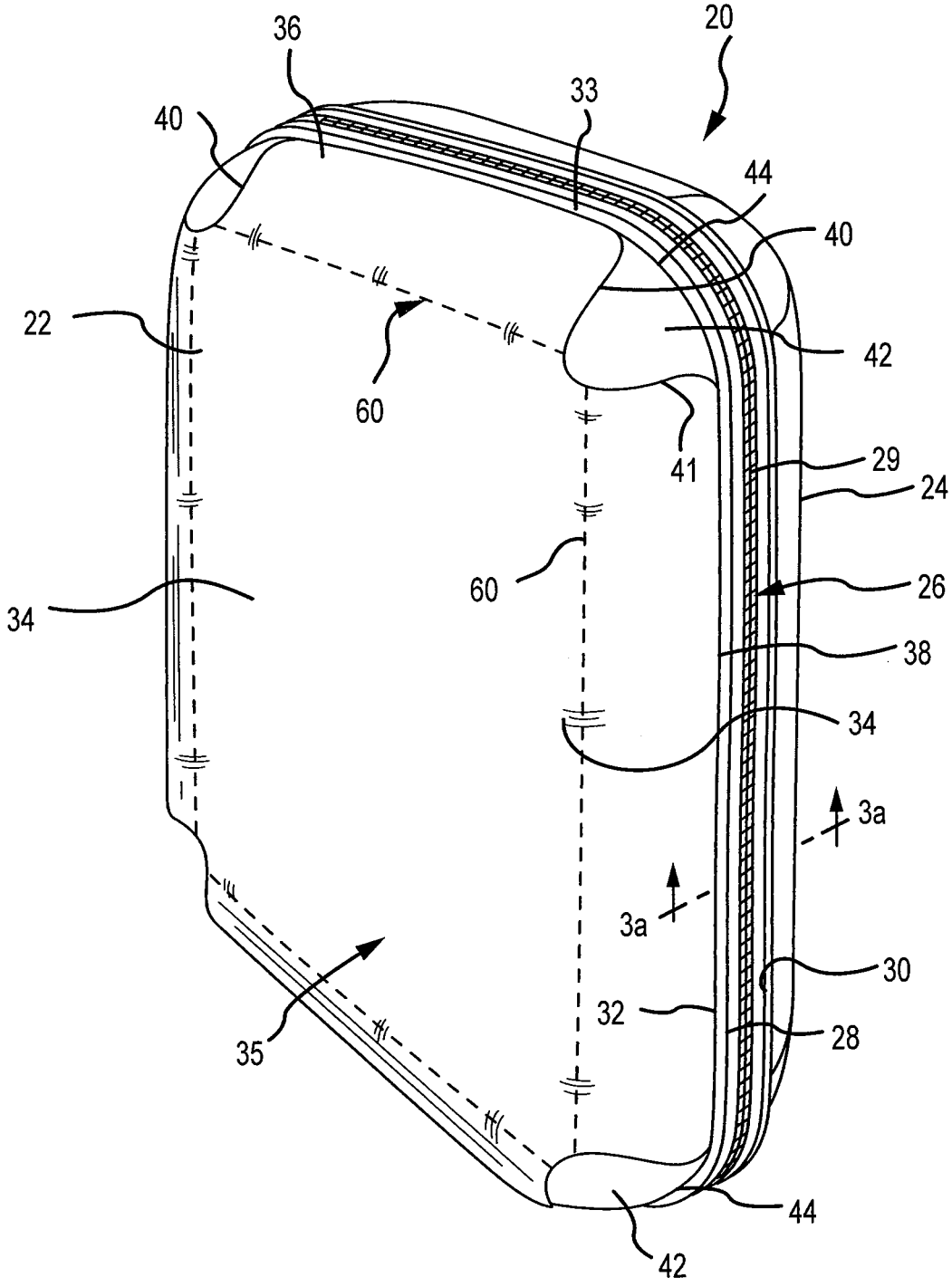
FIG. 1 shows a luggage case incorporating one example of a luggage case construction.

A luggage case 20 is shown in FIG. 1, and includes a front portion 22, a rear portion 24, and an intermediate rim 26 between the front and rear portions 22, 24. Together, the front and rear portions 22, 24, and the intermediate rim 26, define an interior space therein. The front and rear portions 22, 24 may move relative to one another, typically by pivoting, to selectively open and close to allow a user to gain access to the interior space of the luggage case 20. Each of the front and rear portions 22, 24 may define a perimeter edge 28, 30.

In one example, one side of the intermediate rim 26 may be fixedly attached, for example, by an edge bead 33, to one of the perimeter edges 28, 30 (respectively) of the front and rear portions 22, 24, while the other side of the intermediate rim 26 may be releasably attached to the other of the perimeter edges 28, 30. The perimeter edge 28, 30 may be releasably attached to the intermediate rim 26 by one or more zippers 29 joined to the perimeter edge 28, 30 and one side of the intermediate rim 26, buckles, latches, tongue and groove engagements, or other suitable releasable closure mechanism. The intermediate rim 26 may be a rigid structure or a flexible structure.

As referenced above, the front portion 22 and the rear portion 24 may be joined by a hinge structure that allows them to be selectively pivoted relative to each other to different configurations while remaining joined via the hinge structure. For example, the hinge structure may be a living hinge, a piano hinge, hinge brackets or the like. While the structure allowing relative motion is referred to herein as a hinge structure, it should be understood that other examples of luggage cases may employ other structures that allow for other types of movement between the front and rear portions 22, 24.

The hinge structure may be positioned in a variety of locations according to different examples. In one example, for example, where the intermediate rim 26 is fixedly attached to the rear portion 24, then a hinge structure may be positioned between the intermediate rim 26 and the front portion 22. Conversely, if the intermediate rim 26 is fixedly attached to the front portion 22, then a hinge structure may be positioned between the intermediate rim 26 and the rear portion 24. The hinge structure may be positioned along a short side or a long side of the luggage case shown in FIG. 1. The hinge may also replace the intermediate rim along a length if desired.

As known in the art, the luggage case 20 may also include any of a carry handle, an extendable pull handle, or wheels as desired. For example, the luggage case 20 may include 2 wheels, 4 wheels, or some other number of wheels. External pockets or other additional structure may be included on the luggage case if desired.

While the luggage case 20 shown in FIG. 1 includes a front portion 22, rear portion 24, and an intermediate rim 26 between the front and rear portions 22, 24, it should be understood that other embodiments may only include front and rear portions 22, 24 with no intermediate rim 26 therebetween. In such embodiments, the front and rear portions 22, 24 may collectively define the interior space. The front portion 22 and the rear portion 24 may be joined by a hinge structure that allows them to be selectively pivoted relative to each other to different configurations while remaining joined via the hinge structure. When pivoted to other positions where the abutting edges of front and rear portions 22, 24 are separated, the interior space may be accessed. When pivoted to a closed position, the perimeters 28, 30, are configured to mate together sufficiently, such as by a tongue and groove engagement, to help maintain their orientation. Buckles, latches, circumferential straps, or other closure devices associated with the front and rear portions 22, 24 may be employed to keep the front and rear portions 22, 24 in a closed orientation. The engagement structure of the rims 28, 30 may be integrally formed with the front 22 or rear 24 portion of the sheet, or may be formed separately by a similar or dissimilar material and attached thereto.

For the purposes of describing the inventive aspects herein, reference will be made to the construction of the front portion 22 of the luggage case 20, it being understood that the described construction may be applied to the rear portion 24, and to luggage cases that include only one portion or more than two portions. In other words, this construction may be applied to a portion of a luggage case, or may be applied to the entirety of a luggage case depending on the particular peripheral shape, structure, and features of a specific luggage case. Also, while described herein with respect to a soft-sided luggage case, this construction may also apply to hard sided luggage cases, hybrid luggage cases (i.e. combinations of soft and hard sided luggage), luggage cases with flexible yet rigid side panels, business cases, duffle bags, backpacks and purses.

The front portion 22 of the luggage case of FIG. 1 includes a first outer material 34 forming a main panel 35 curving away about a shoulder 60 to a top edge 36, a right lateral edge 38, a left lateral edge (not shown, but similar to right lateral edge 38), and bottom lateral edge (not shown, but similar to top edge 36). The main panel 35 may be made of a material (woven or non-woven) that is both soft and flexible, yet sufficiently structural so as to provide structure to the main panel 35. The main panel 35 may be formed from a variety of materials, including, but not limited to, foam, plastic, rubber, fabric, and so on. The main panel 35 may be formed from a single layer of material, or from multiple layers of material. The central portion of the main panel may be relatively flat, and curves towards the intermediate rim 26 near the edges 36, 38. As will be further described below, the edges 36, 38 of the main panel 35 may be attached by an second wire frame element 32 to the intermediate rim 26.

In one embodiment, a cutout 40 may be formed in each corner of the main panel 35 of the first outer material 34 where the edges of the material 34 would otherwise typically intersect. The cutouts 40 may provide aesthetic benefits, in that they may allow for the formation of seamless, rounded corners, and may also allow for the application of a second outer material 42 different from the first outer material 34 on the corners of the luggage case 20. In some embodiments, the second outer material 42 may be visually distinct from the first outer material 34, for example, by using materials of contrasting color or texture, to create a distinctive luggage case design. In other embodiments, the second outer material 42 may be formed from a wear-resistant material, such as wear-resistant fabric, rubber, plastic, vinyl, and so on, to protect the corners of the luggage case 20, which are often more subject to wear and tear than other portions of the case 20. In other embodiments, the second outer material 42 may be formed from an injected material or a hard material such as plastic or metal.

The second outer material 42 is attached along an edge 44 to the intermediate rim 26, such as by an second wire frame element 32. The second material 42 is also attached along or adjacent to the abutting edges 41 of the cutouts 40 to the first outer material 34, such as by sewing, stapling, riveting, bonding or the like. The second outer material 42 and the cutouts 40 in the main material 40 are not required.

In one embodiment, the main panel 35 of the first outer material 34 may be seamless as it curves from the main panel towards the lateral edges and intermediate rim 26. This curvature provides a smooth, substantially seamless transition curve from a main face (i.e. 35) to minor peripheral faces that define the edges that engage intermediate rim 26. In other words, the main panel 35 may be substantially free of any seams, stitching marks or lines, or other anchor structures, caused by attaching the second outer material 42 to the first outer material 34, and interrupting the main panel 35 in the regions between the cutouts 40 or in the central portion of the panel 35. Also, the main panel 35 is curved around the shoulders 60 defined between the main panel 35 and edge panels 36, 38, in a manner that is substantially free of any seams, stitching marks, or lines, or other anchor structures, which are typically caused by forming the edge panels 36, 38 relative to the main panel 35 in a standard non-hardside luggage case. This lack of interruption in the first outer material 34 is facilitated by the wire frame anchoring construction shown and described herein.

Figure 2:
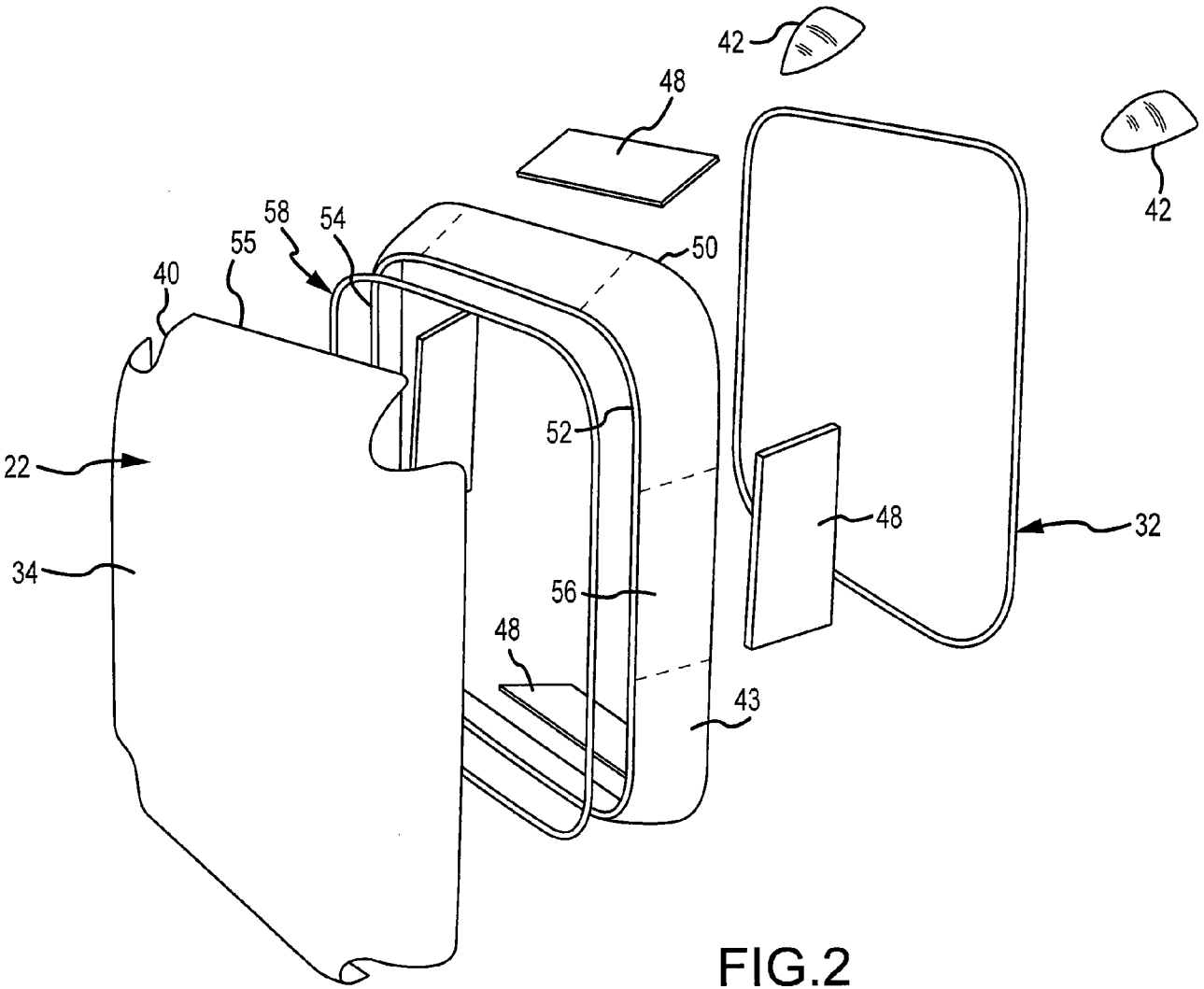
FIG. 2 shows a simplified exploded view of the front half of the luggage case of FIG. 1.

FIG. 2 illustrates the components of the first portion 22 of the luggage case 20. The first outer material 34 is shown as having a generally rectangular shape defining cutout 40 corners as described above. The second outer material portions 42 that are positioned within or over the cutouts 40 in the corners are also shown. An inner material, or liner collar 43, may be positioned inside the luggage case, and may have a generally rectangular shape with rounded corners. The liner collar 43 generally forms an interior surface that overlays the interior-facing surfaces of the outer materials 34, 42. In some embodiments, the liner collar 43 material may also be attached to the second outer material 42 along the same edge where the first and second outer materials 23, 42 are attached together. The liner collar 43 may be made from a non-woven fabric material. In some embodiments, the liner collar 43 may be made from an injected material, such as a foam, elastomeric, or plastic material.

The liner collar 43 may extend forwardly from an inner perimeter edge 50 positioned adjacent to or overlapping the intermediate rim 26, to an outer perimeter edge 52. The width of the liner collar 43, which is the distance from the inner perimeter edge 50 and the outer perimeter edge 52, may be such that both the cutouts 40 and the second outer material 42 are overlapped by the liner collar 43 on the interior-facing side. The straight portions, or corners, of the liner collar 43 may include recesses or pockets configured to receive one or more structural members 48, such as flexible polymer foam or polymer sheets, configured to provide some shape retention and structural support. In one embodiment, each structural member 48 may be formed from a structurally resilient material that substantially assumes its original shape after it is bent or otherwise deformed.

As will be further described below, the structural members 48 may serve to bias the wire frame against the outer layer(s) 34, 42, and, in this way, keep the outer layer 34, 42 in the desired shape and position. In one embodiment, the liner collar 43 may be sloped along its width to match the curvature of the main panel 35 where it may curve over the shoulder 60 to form edge panels 36, 38, whose edges meet the intermediate rim 26. In some embodiments, the minimum and maximum dimensions of the inner perimeter edge 50 may be greater than the same corresponding features of the outer perimeter edge 52, creating the slope along the width of the liner collar 43. The liner collar 43 may thus have a three-dimensional configuration, such that the inner and outer perimeter edges 50, 52 are positioned on separate planes. In other embodiments, the liner collar 43 may have a two-dimensional, rather than a three-dimensional, configuration.

The liner collar 43 may be continuous, as shown in FIG. 2, or may be discontinuous as is required of the particular luggage case configuration in which the tent structure is utilized. For example, the liner collar 43 is continuous, as shown in FIG. 2, the structural members 48 may be placed in pockets formed in the liner collar 43. Where the liner collar 43 may be continuous, discontinuous, or partial, the structural members 48 may be positioned in or held in place by pockets, or secured in place by sewing, adhesives, rivets, or some other technique to help secure its location and aid in its function of separating the wires of the tent-frame structure.

Continuing with FIG. 2, an outer hem 54 is formed along at least a portion of the outer perimeter edge 52 of the liner collar 43 and defines an elongated pocket inside the outer hem 54. The pocket of the outer hem 54 may receive an elongated first wire frame element 58 (also shown in FIG. 3) that extends around the outer perimeter edge 52. In one example, the outer hem 54 may be formed around the entire perimeter 52 of the liner collar 43. In other embodiments, the outer hem 54 may extend only partially around the perimeter, or around the entire perimeter, but in separate segments. More particularly, the outer perimeter 52 of the liner collar 43 may be sewn around the first wire frame element 58 to conform or stretch the liner collar 43 to the shape of the first wire frame element 58.

The first wire frame element 58 may extend around the entire perimeter 52 of the liner collar 43 in the hem 54, or may extend around a partial perimeter coincident with the extension of the hem 54. The first wire frame element 58 may also extend in segments coincident with a segmented hem 54. Additionally, the first wire frame element 58 may extend around the entire perimeter and not be positioned in the hem 54 continuously. The hem 54 may only cover part of the first wire frame element 58 to help maintain its position. The first wire frame element 58 may be exposed outside of the hem 54, or may be positioned through and covered by other materials used to construct the luggage case.

The first wire frame element 58 may be made of a wire of any dimension capable of being bent to create the desired structural shape. The first wire frame element 58 may be made of a structurally resistant material, such that the wire may conform to its original shape after being bent. The wire may be formed from metal, or a non-metal material, such as plastic or rubber, if suitable for the purposes described herein. In some embodiments, the first wire frame element 58 may be formed a bundle of wires having smaller cross-sectional dimensions than the overall cross-sectional dimension of the first wire frame element 58.

The second wire frame element 32 may be attached, as by sewing for instance, to the inner perimeter 50 of the liner collar 43, to the linear edges 55 of the first outer material 34 that extend between the cutouts 40, and to the inner edges of the second outer material 42. The second wire frame element 32 may be received inside a hem structure, as shown and described in FIG. 3*a*, such that the second wire frame element 32, together with the hem structure, may form an edge bead structure 33. In one embodiment, the second wire frame element 32 may be a wire frame element similar to the first wire frame element 58 positioned around the outer perimeter 52 of the liner collar 43.

Figure 4:
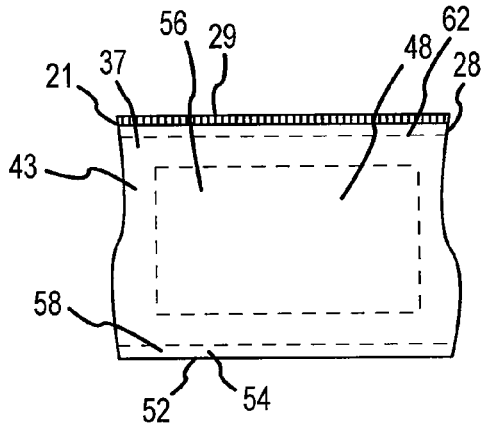
FIG. 4 illustrates a partial cutaway view of a portion of the liner collar of the luggage case shown in FIG. 3*a* from the interior of the luggage case.

The liner collar 43 may form recesses 56 or pockets (noted by dashed lines) in order to receive the structural members 48, which keep the second wire frame element 32 and the first wire frame element 58 spaced apart from one another, on opposite sides of the structural member 48. One example of recesses 56 that can be used to form the structural members 48 is shown in FIG. 4.

The first wire frame element 58 may serve as an anchor to which the liner collar 43 is attached at its outer perimeter 52. The first wire frame element 58 may further provide structural rigidity to at least the outer perimeter 52 of the liner collar 43 to allow it to extend along the inside surface of the first outer material 34 and second outer material 42 at least partially or entirely to support the materials 34, 42 in position without requiring the first and second outer materials 34, 42 to be attached to the liner collar 43 in those regions. As referenced above, this eliminates the need to have any type of stitching, seam, or other interruption of the first outer material 34 in this region to provide support to the assembled structure, and allows a clean-lined, interruption free outer material along the main panel 35 and around the curved portions of the edge panel 36, 38.

Figure 3A:
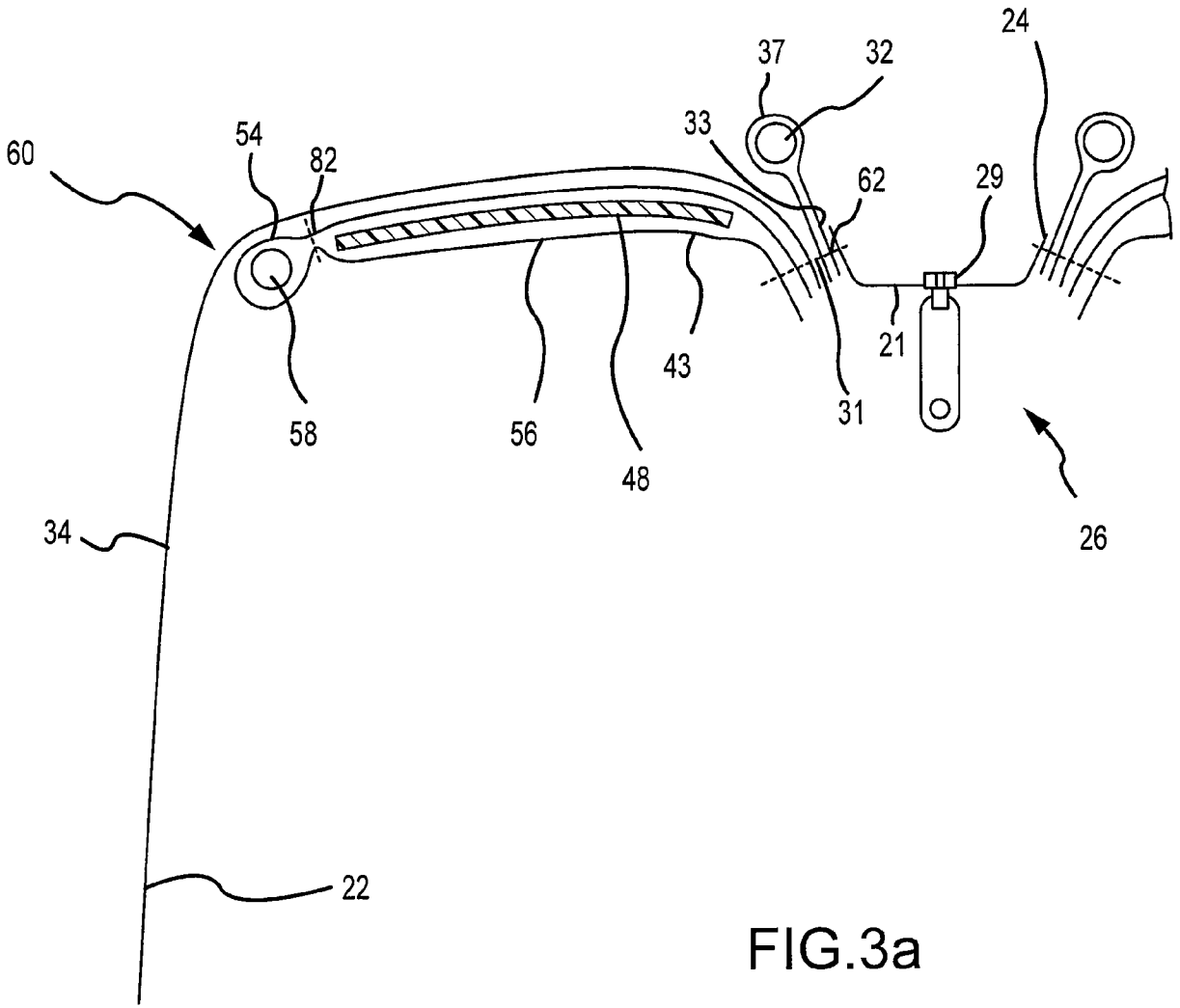
FIG. 3*a* is a cross section taken along line 3*a*-3*a* of FIG. 1, and shows the various components making up the luggage construction, including the outer material, support structure, first and second wire frame, liner collar with pocket for the support structure, and zipper.

FIG. 3*a* is a cross section view taken along line 3*a*-3*a* of FIG. 1 and further exemplifies the benefit of using the first wire frame element 58 in the liner collar 43 as the support for the first outer material 34 to allow it to curve from the major face to the minor faces without the need for attaching the first outer material to a frame member at or near the transition. The first wire frame element 58 also acts at the anchor to which the liner collar 43 is attached. As referenced above, the liner collar 43 forms a hem at its outer perimeter 52, which receives the first wire frame element 58. The hem 54 receives the first wire frame element 58 therethrough to secure the liner collar 43 to the wire frame element 58.

As referenced above, the liner collar 43 may be attached to the first wire frame element 58 after it has been formed into a desired shape. This attachment may be provided by a hem 54 around the outer perimeter edge 52 of the liner collar 43. The hem 54 may receive the wire frame 58 therethrough to secure the liner collar 43 (in this case the liner collar 43) to the first wire frame element 58.

The pocket 56 defined in the width of the liner collar 43 may receive the structural member 48. The structural member 48, when positioned in the pocket 56, serves to space the first wire frame element 58 away from the bead edge 32, as well as provide structural reinforcement to the front portion 22 and to the minor faces of the front portion 22 where the structural member(s) are positioned. As shown in FIGS. 3*a* and 4, the first wire frame element 58 may be biased away from the bead edge 32 against the front outer material 34 to form a line 60 or shoulder region around which the first outer material 34 is bent or curved. As shown in FIG. 1, in one embodiment, the line 60 of bending may extend between the apexes of the corner cutouts 40 (see FIG. 1).

As shown in FIG. 3*a*, the first outer material 34 may overlap the liner collar 43, and extend coextensively with the liner collar 43 along its width and beyond the structural member 48 towards the edge bead 33. The edge bead 33 may include the second wire frame element 32 received inside a hem 37 and the tails 31 of the hemmed edge bead 33. The edge 38 of the first outer material 34, liner collar 43, and the tails 31 of the edge bead 32 may be attached together at an attachment point or area 62 to create the fixed structure.

In one embodiment, the first wire frame element 58 at the outer perimeter 52 of the liner collar 43 is not attached to the first outer material 34 at any other attachment point. In other words, the only point at which the liner collar 43 and the first wire frame element 58 are attached to the first outer material 34 is the attachment point 62 located near the second wire frame element 32 and adjacent the intermediate rim 26 between the front and rear panels 22, 24. The first outer material 34 thus curves from the main face to a minor face without attachment to an underlying frame structure at or near the line of curvature 60. The first outer material is simply supported from the inside at the line of curvature 60. Accordingly, the first outer material 34 may be overlaid onto the first wire frame element 58 to take the shape of the first wire frame element 58 without being attached or anchored to the first wire frame element 58. This keeps any seams, sew lines, or other interruption from being formed in the first outer material 34, and provides a clean line in the outer materials 34, 42. Therefore, any interruptions in the first outer material 34 caused by anchoring the second outer material 42 or the first wire frame element 58 thereto are eliminated or significantly reduced. The structural members 48 thus serve to space the first wire frame element wire 58 away from the second wire frame element 32, which in turn biases the wire frame 58 against the outer material(s) 34, 42, and, in this way, keeps the outer material(s) 34, 42 in the desired shape.

As shown in FIG. 3*a*, the first wire element 58 and the second wire element 32 may be attached to the zipper 29 extending around the intermediate rim 26 of the luggage case 20 at the attachment point 62 located near the second frame element 32. More particularly, in one embodiment, the tape 21 of the zipper 29 may be positioned under the lining 43, and sewn (or otherwise attached) at the attachment point 62 to the lining 43, the first outer material 34, and the edge bead 33. In other embodiments, the tape 21 of the zipper 29 may be positioned between over the edge bead 33, or between the edge bead 33 and the first outer material 34.

Figure 6:
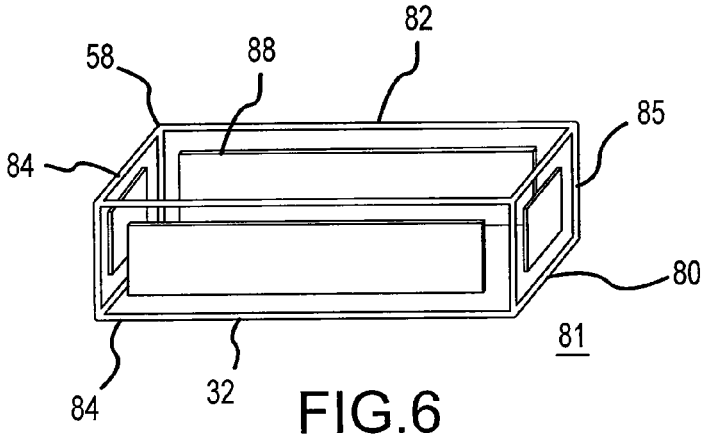
FIG. 6 shows a schematic view of another example of a wire frame that may be used in conjunction with another example of a luggage case construction.

The structural member 48 may further serve to maintain the first wire frame element 58 in a desired location and prevent it from shifting relative to the front panel 22, thereby reducing the need to attach the first wire frame element 58 to an additional support structure or anchor. The size and shape of the structural member 48 may vary according to different examples of luggage cases. For example, some embodiments may use multiple structural members 48 that are positioned intermittently along the length of the first wire frame element 58, as shown in FIG. 2, to maintain the first wire frame element 58 in a desired position. Other embodiments may utilize smaller or larger structural members 48 than those illustrated in the Figures. It is further contemplated that in some embodiments, the first wire frame element 58 may be sufficiently supported by its own geometry, or by engagement with the first outer material 45, the second outer material 42, other frame members, or a combination, so that structural members 48 are not required. One example of such a configuration is shown in FIG. 6. In other embodiments, the frame may also have structural members that are just column-like support wires or pieces of plastic that extend around the perimeter of the luggage case, in the panels, or through the interior of the luggage case.

In some embodiments, the first wire frame element 58 or the outer perimeter 52 of the liner collar 43, may be tacked to the first outer material 34 at intermittent locations along the outer perimeter 52 along the inside surface of the first outer material 34. Such an attachment by a tack structure, which can include, for example, a single or very few sewing stitches or the like, can be less perceptible than a longer seam or sew-line. The tack structure may be able to be associated with or hidden by design features or other structures (such as branding badge, pocket zipper seams, or the like) provided in the inside or outside surface of the first outside material 34, so as to not be noticeable from the outside-facing surface of the first outside material 34. In this way, a first outer material 34 may be kept substantially free of interruption even if intermittent tacking is utilized.

The liner collar material 43 may be anchored to the first wire frame element 58 and held in position by the first wire frame element 58 without the liner collar material 43 or the first wire frame element 58 being attached to the first outer material 34, thus providing the benefit of an uninterrupted expanse of the outer material 34 described above. The first wire frame element 58 may also form a structural skeleton about which the first outer material 34 is overlaid or positioned and fastened along intersecting edges of the outer material 34 where necessary, but not requiring seams or beads in the middle of the first outer material 34 to attach it to the first wire frame element 58. The wire frame 58 may be a single portion of the frame of a traditionally built case, or the wire frame 58 may be the only type of frame in the luggage case. In some embodiments, a plurality of first wire frame elements 58 may be combined together to form a portion of a periphery of a luggage case.

As referenced above, the structure described herein allows for constructing a luggage case from the inside to the outside, as opposed to the typical manner of constructing a luggage case from the outside to the inside. In short, the first wire frame element 58 is formed to create the desired overall peripheral shape, or a portion of the overall shape, of a luggage case. As shown in FIG. 3*a*, the liner collar material 43 may be anchored to the first wire frame element 58 to form a layer that will be inside the outer layer(s) 34, 42 of the case. Structural members 48 may then be positioned where needed to maintain the wire frame in a proper position and reinforce the structure of the luggage. It is contemplated that the structural members 48 may be positioned in pockets formed in the liner collar 43, or may be held in position in other ways to help maintain the configuration of the wire frame 58. The outer material 34, 42 is then overlaid onto the first wire frame element 58 and liner collar 43 combination and attached where needed, such as by sewing near the second wire frame element 32, to configure the shape of the luggage case. This creates a type of skeleton structure over which the outer material 34, 42 is positioned and formed. The closure mechanism and other external components may then be assembled to the luggage case. It is also contemplated that the outer material may be overlaid in sections, or may be partially formed into the final shape before being overlaid onto the wire frame structure.

Figure 3B:
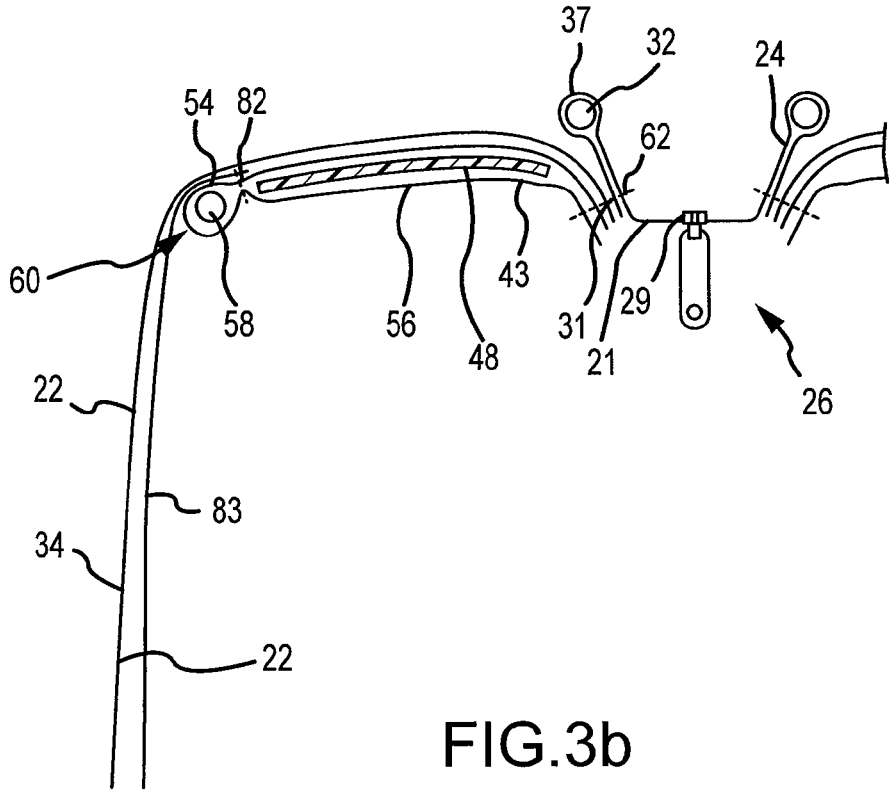
FIGS. 3*b* and 3*c* show additional representative examples of the cross section in FIG. 3*a*.
Figure 3C:
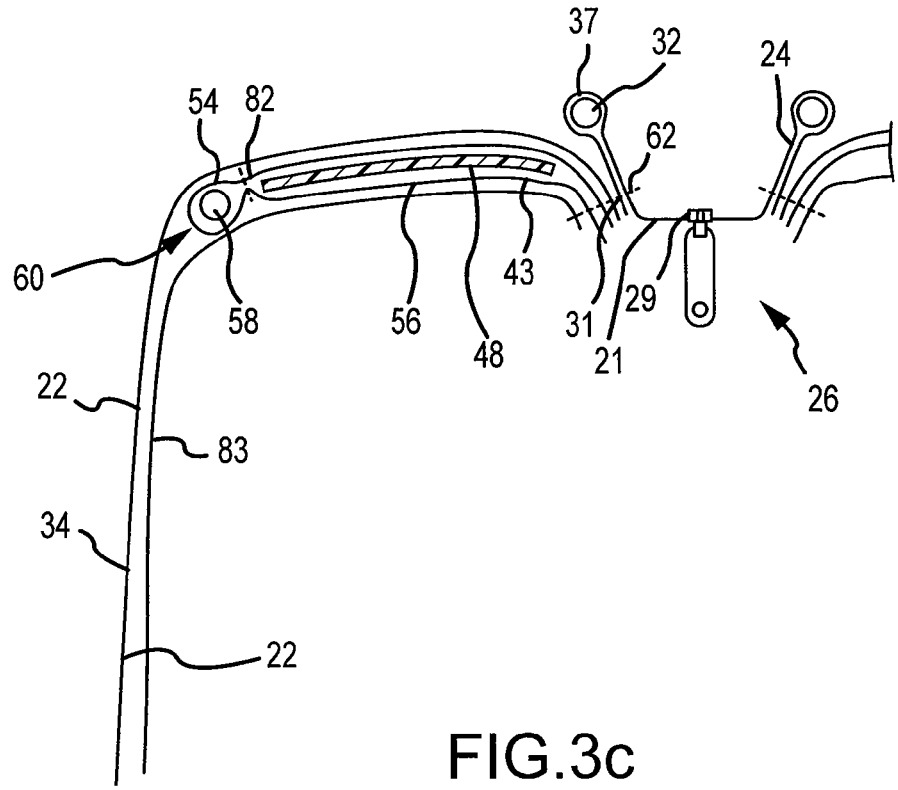

In other embodiments, as shown in FIGS. 3*b* and 3*c*, the luggage case may include an aesthetic layer that lines at least a portion of the interior of the case. As shown in FIG. 3*b*, the aesthetic layer 83 may be positioned underneath the first wire element 58 so as to cover the main panel 35 of the front portion 22. The aesthetic layer 83 may be attached to the liner collar 43 at an attachment point 82 joining the liner collar 43 to the aesthetic layer 83. In such embodiments, the aesthetic layer 83 may only cover the main panel 35 of the front portion 22, while the liner collar 43 covers the edges of the front portion 22. FIG. 3*c* illustrates another embodiment, in which the aesthetic layer 83 may cover the entire interior surface of the front portion 22. In such embodiments, the aesthetic layer 83 may be attached at the attachment point 62 adjacent the intermediate rim 26, such that the aesthetic layer 83 covers both the top and side edges, as well as the main panel 35 of the front portion 22.

FIG. 4 illustrates a partial cutaway view of a portion of the liner collar 43 of the luggage case shown in FIG. 3*a* from the interior of the luggage case. As discussed above, the collar 43 may be configured to receive one or more structural members 48 in one or more recessed portions 56 or pockets, which may keep the first wire frame element 58 and the second wire frame element 32 apart. An outer hem 54 may be formed along at least a portion of the outer perimeter edge 52 of the liner collar 43. The outer hem 54 may receive the first wire frame element 58. As discussed above, the luggage case may be finished by attaching the tails 31 of the bead structure 33 (shown in FIGS. 3*a*-3*c*) containing the second wire frame element 32 to the perimeter edge 28 of the front portion 22 to the tape 21 of a zipper 29, the outer material 34, and the outer perimeter edge 52 of the liner collar 43, at the attachment point 62.

Figure 5:
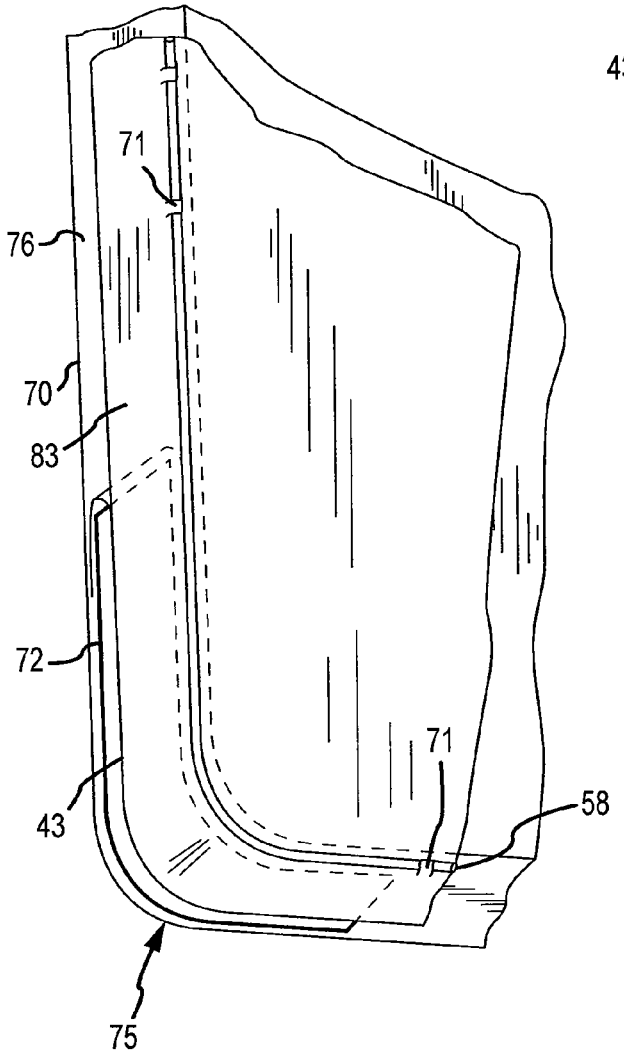
FIG. 5 shows a perspective partial cutaway view of the interconnection of the various components in another example.

FIG. 5 shows a perspective partial cutaway view of another example of a luggage case construction 70 using a first wire frame element 58. In this example, the corner portion of the luggage case 70 is formed with the first wire frame element 58 held in position by a structural member 72 positioned in or attached to the liner collar 43 through a corner curve, as discussed above with respect to other embodiments. An aesthetic layer 83 may be positioned on top of the liner collar 43 and the structural members 72, for example, to conceal these components from a user viewing the interior of the case. The aesthetic layer 83 may be attached to the first wire frame element 58 at various attachment areas 71 to hold it in position relative to the outer material 76. As shown in FIG. 4, the attachment areas 71 may be formed by holes in the aesthetic layer 83 through which the first wire frame element 58 is fed. The support structure 72 bends around a corner to not only support the first wire frame element 58, but also to provide some structural reinforcement to the corner of the luggage case 70 (such as to provide sufficient structure to attach wheels or the like). The outer material 76 may be overlaid on the first wire frame element 58, but is not attached thereto. The inner edge 75 may be finished by attaching a bead structure 33, such as that shown and described in FIGS. 3*a*-3*c*.

FIG. 6 shows a three-dimensional wire frame 80 that can be used to form another example of a front or rear portion of a luggage case construction, with the liner collar and the outer material removed to better illustrate the structural components of the case 81. As with the other embodiments described above, a liner collar 43 (as shown in FIGS. 1-4) may be attached to the wire frame 80 and anchored thereto, and the outer perimeter 82 of the liner collar 43 (which includes the first wire frame element 58) can be held apart from the inner perimeter edge 84 of the liner collar 43 (which includes the second wire frame element 32 by columns 85 positioned between the two perimeters 82, 84. In some embodiments, as shown in FIG. 6, the columns 85 may be positioned in the corners of the luggage case, while other embodiments may include columns 85 positioned on the side edge portions of the front or rear portion. The columns 85 may be formed from the same piece of wire as the first and/or second wire frame elements 32, 58, or may be formed as a separate piece. The columns 85 may alone keep the wire frame elements 58, 32 apart, or may act in conjunction with additional structural members 88. The liner collar 43 may be finished as described above with respect to FIGS. 3*a* to 3*c*, for example, by attaching an edge bead 32 and a zipper 29.

Figure 7:
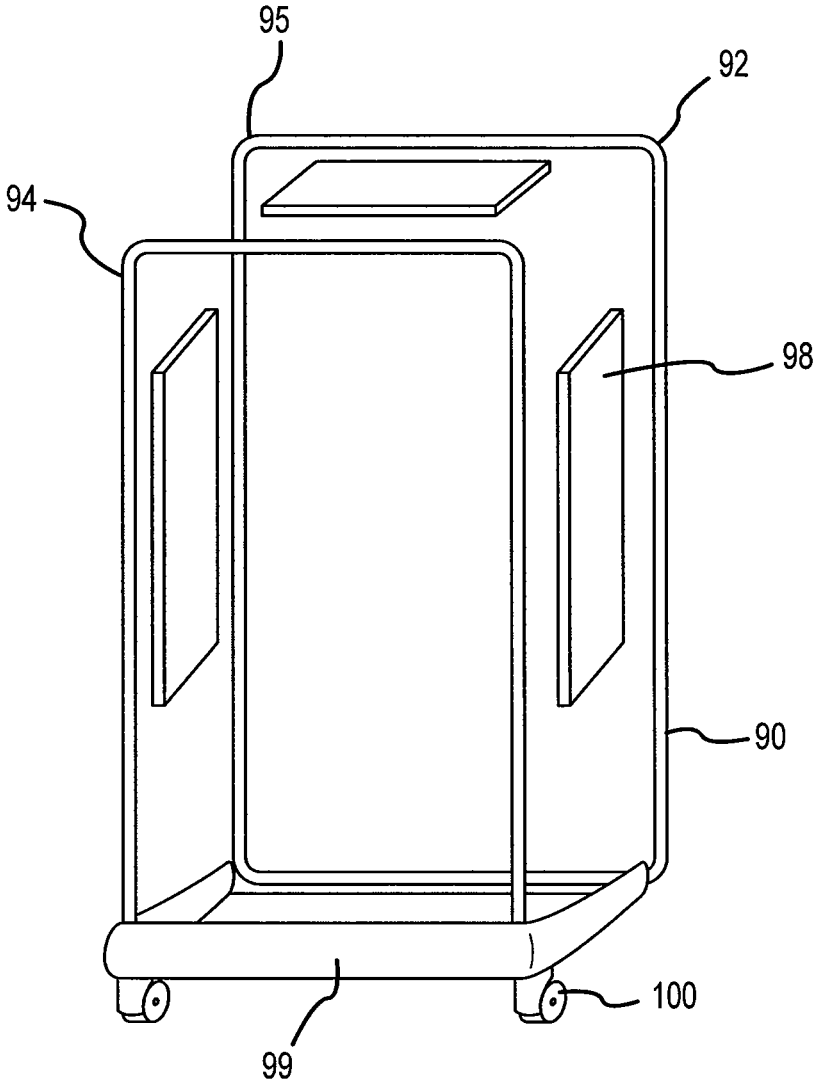
FIG. 7 shows a schematic view of the wire frame and structural material of the front portion of a wheeled luggage case incorporating another example of a luggage case construction.

FIG. 7 shows a three-dimensional wire frame 90 including two spaced-apart frame elements 94, 95 that can be used to form another example of a front or rear portion 90 of a luggage case having wheels 199. The liner collar 43 (as shown in FIGS. 1-4) and the outer material have been removed to better illustrate the structural components of the case, but as in previous embodiments, may be attached to the frame 90 and anchored thereto. As shown in FIG. 7, the two frames elements 94, 95 can be held apart by a combination of structural members 98 and a base member 99 with one or more wheels 100 mounted thereon. The liner collar 43 may be finished as described above with respect to FIGS. 3*a* to 3*c*, for example, by attaching an edge bead 32 and a zipper 29.

The wire frame structure defined herein provides a lightweight means to construct and configure a luggage case with fewer interruptions of the major panels of the luggage case caused by anchoring the interior materials to and through the outer material panels. This construction may be used for entire luggage cases, or portions of luggage cases. It is also capable of being used on hard side luggage cases to position the liner collar inside without having to attach the liner collar to the hard-side members in the middle of a span. Because the wire frame construction can be done efficiently by hand using traditional sewing and assembly methods to obtain the clean uninterrupted spans of outer fabric, luggage manufacturers do not need to rely as much on hard-sided luggage styles produced by more expensive molding processes.

While the methods disclosed herein have been described and shown with reference to particular steps performed in a particular order, it will be understood that these steps may be combined, subdivided, or re-ordered to form an equivalent method without departing from the teachings of the present invention. Accordingly, unless specifically indicated herein, the order and grouping of the steps are not generally intended to be a limitation of the present invention.

A variety of embodiments and variations of structures and methods are disclosed herein. Where appropriate, common reference numbers were used for common structural and method features. However, unique reference numbers were sometimes used for similar or the same structural or method elements for descriptive purposes. As such, the use of common or different reference numbers for similar or the same structural or method elements is not intended to imply a similarity or difference beyond that described herein.

The references herein to "up" or "top", "bottom" or "down", "lateral" or "side", and "horizontal" and "vertical", as well as any other relative position descriptor are given by way of example for the particular embodiment described and not as a requirement or limitation of the shade or the apparatus and method for assembling the shade. Reference herein to "is", "are", "should", "would", or other words implying a directive or positive requirement are intended to be inclusive of the permissive use, such as "may", "might", and "could," unless specifically indicated otherwise. Fluid as referred to herein may be both liquid and gaseous phases of materials.

The apparatus and associated method in accordance with the present invention has been described with reference to particular embodiments thereof. Therefore, the above description is by way of illustration and not by way of limitation. Accordingly, it is intended that all such alterations and variations and modifications of the embodiments are within the scope of the present invention as defined by the appended claims.

The references herein to "up" or "top", "bottom" or "down", "lateral" or "side", or "horizontal" or "vertical," as well as any other relative position descriptor are given by way of example for the particular embodiment described and not as a requirement or limitation of the shade or the apparatus and method for assembling the shade.

The apparatus and associated method in accordance with the present invention has been described with reference to particular embodiments thereof. Therefore, the above description is by way of illustration and not by way of limitation. Accordingly, it is intended that all such alterations and variations and modifications of the embodiments are within the scope of the present invention as defined by the appended claims.

The invention claimed is:

1. A luggage case comprising:

a first wire frame element forming at least a partial shape of a main body of the luggage case;

an inner material defines a pocket receiving at least a portion of the first wire frame element;

an outer material;

the outer material curves around at least a portion of the first wire frame element that forms a shoulder between a main panel and an edge panel of the outer material; and the outer material is substantially free of any interruptions created by attaching the first wire frame element to the outer material where the outer material curves around said at least a portion of the first wire frame element that forms the shoulder between the main panel and the edge panel of the outer material.

2. The luggage case of claim 1, wherein said at least a portion of the first wire frame element that forms the shoulder between the main panel and the edge panel of the outer material comprises a central portion of the first wire frame element.

3. The luggage case of claim 1, wherein the inner material comprises a fabric.

4. The luggage case of claim 1, wherein the inner material defines one or more second pockets configured to receive one or more structural members.

5. The luggage case of claim 4, wherein the structural members are configured as one or more plates.

6. The luggage case of claim 4, further comprising a second wire frame element attached at least in part to the inner material and the outer material, and the one or more structural members bias the first wire frame element away from the second wire frame element.

7. The luggage case of claim 6, wherein the one or more structural members are formed from a structurally resilient material.

8. The luggage case of claim 1, wherein the outer material comprises:

a first portion positioned over a central portion of the first wire frame element; and a second portion positioned over a corner portion of the first wire frame element.

9. The luggage case of claim 1, further comprising a second wire frame element spaced apart from the first wire frame element.

10. The luggage case of claim 9, wherein the first wire frame element and the second wire frame element are held apart by a combination of structural members and a base member with one or more wheels mounted thereon.

11. The luggage case of claim 9, wherein one of the first wire frame element and the second wire frame element forms a support structure for a front portion of the luggage case, and the other of the first wire frame element and the second wire frame element forms a support structure for a rear portion of the luggage case.

12. The luggage of claim 1, wherein the first wire frame element comprises a bent wire frame.

13. The luggage case of claim 1, wherein the outer material curves around the length of said at least a portion of the first wire frame element that forms the shoulder between the main panel and the edge panel of the outer material.

14. A method of making a luggage case comprising:

forming a first wire frame element into at least a portion of a shape of the luggage case;

positioning at least a portion of the first wire frame element into a pocket defined by an inner material; and laying an outer material over the first wire frame element to form an outer wall of the luggage case wherein the outer material curves around at least a portion of the first wire frame element that forms a shoulder between a main panel and an edge panel of the outer material, and the outer material is substantially free of any interruptions created by attaching the first wire frame element to the outer material where the outer material curves around said at least a portion of the first wire frame element that forms the shoulder between the main panel and the edge panel of the outer material.

15. The method of claim 14, further comprising forming the first wire frame element into a bent wire frame, and providing a fabric for the inner material.

16. The method of claim 14, further comprising spacing a second wire frame element away from the first wire frame element.

17. The method of claim 14, wherein the outer material curves around the length of the at least a portion of the first wire frame element that forms the shoulder between the main panel and the edge panel of the outer material.

* * * * *